US006467885B2

(12) United States Patent
Tanaka et al.

(10) Patent No.: US 6,467,885 B2
(45) Date of Patent: Oct. 22, 2002

(54) INK JET RECORD HEAD

(75) Inventors: Ryoichi Tanaka, Nagano (JP); Tomoaki Takahashi, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 105 days.

(21) Appl. No.: 09/764,102

(22) Filed: Jan. 19, 2001

(65) Prior Publication Data

US 2001/0024221 A1 Sep. 27, 2001

(30) Foreign Application Priority Data

Jan. 19, 2000 (JP) ..... 2000-010655
Dec. 26, 2000 (JP) ..... 2000-395378

(51) Int. Cl.[7] ..... B41J 2/045
(52) U.S. Cl. ..... 347/68
(58) Field of Search ..... 347/68–71, 40–41, 347/20, 47; 310/311, 313 A, 348, 324

(56) References Cited

U.S. PATENT DOCUMENTS 4,730,197 A * 3/1988 Raman et al. ..... 347/10
5,790,155 A * 8/1998 Usui et al. ..... 347/68
6,155,677 A * 12/2000 Kitani et al. ..... 347/20
6,338,549 B1 * 1/2002 Kitahara et al. ..... 347/68
6,371,601 B1 * 4/2002 Katakura ..... 347/68

* cited by examiner

*Primary Examiner*—John Barlow
*Assistant Examiner*—K. Feggins
(74) *Attorney, Agent, or Firm*—Sughrue Mion, PLLC

(57) ABSTRACT

An ink jet record head which has rows of pressure generation chambers (1) having nozzle openings (5), common ink reservoirs (2) placed along the row direction of the pressure generation chambers, ink supply passages (3) for communicating the ink reservoirs with the pressure generation chambers to communicate with each other, and piezoelectric vibrators for causing the pressure generation chambers to generate pressure. The opening parts of the ink supply passages in the proximity of each end part of the ink reservoir are arranged closely as compared with the opening parts of the ink supply passages in the proximity of the center of the ink reservoir.

16 Claims, 11 Drawing Sheets

INK JET RECORD HEAD

BACKGROUND OF THE INVENTION

1. Technical Field

This invention relates to an ink jet record head for ejecting ink droplets through nozzle openings with pressure fluctuations in pressure generation chambers, thereby recording images and characters on record paper.

2. Related art

Generally, an ink jet record head shown using piezoelectric vibrators as pressure generation elements is designed as in FIGS. 9 and 10, which will be hereinafter referred to simply as a record head. The record head comprises a head case 10 and a flow passage unit 9 fixedly secured to the unit fixation face of the head case 10 (the top face thereof in FIG. 9) with an adhesive, etc. The flow passage unit 9 is made up of a nozzle plate 6, a flow passage board 4, and a vibration plate 8 stacked one on another.

The nozzle plate 6 is formed with a large number of nozzle openings 5 arrayed in rows (in a direction perpendicular to the plane of FIG. 9). The flow passage board 4 is formed with flow passages, which include pressure generation chambers 1 communicating with the respective nozzle openings 5, ink reservoirs 2 for temporarily storing ink to be ejected through the nozzle openings 5, and ink supply passages 3 for supplying ink from the ink reservoirs 2 to the pressure generation chambers 1.

The pressure generation chambers 1 are arrayed to correspond in location to the respective nozzle openings 5, and each ink reservoir 2 is elongated along the row of the associated pressure generation chambers 1.

The vibration plate 8 is a composite plate of a resin sheet and a stainless sheet, and is formed with ink supply ports 12 (not shown in FIG. 9) for introducing ink into the ink reservoirs 2.

The head case 10 is formed with windows 16 in the portions corresponding to the respective rows of the pressure generation chambers 1 for exposing piezoelectric vibrators 7 therefrom. In FIG. 9, numeral 18 denotes a fix board for fixing the piezoelectric vibrators 7, and numeral 19 denotes a chamber for housing a piezoelectric vibrator unit comprising the piezoelectric vibrators 7 fixed onto the fix board 18.

However, in the record head, when an ink cartridge is attached or detached, an air bubble 11 may enter and flow into the ink reservoir 2. If the air bubble 11 thus enters the ink reservoir 2, as shown in FIGS. 10 and 11, the air bobble 11 is caught in an end part of the ink reservoir 2 and grows, and flows into the pressure generation chamber 1 because of the reciprocating operation of a carriage, vibration, etc., easily causing a print failure of so-called dot dropout, etc.

The bubble 11 entering the ink reservoir 2 is forcibly sucked and removed through the nozzle opening 5 by the suction operation, etc., as cleaning. However, the flow velocity of ink during the sucking operation is low in the proximity of the end part of the ink reservoir 2, and the air bubble 11 is likely to remain without being discharged, easily causing a print failure of so-called dot dropout, etc.

SUMMARY OF THE INVENTION

It is therefore an object of the invention to provide an ink jet record head for making it possible to reliably remove air bubbles in ink reservoirs by the suction operation of cleaning, etc.

To achieve the above-mentioned object, the present invention provides an ink jet record head including:

pressure generation chambers arrayed in at least one row and associated with at least one nozzle openings;

at least one common ink reservoir elongated along a row direction of the pressure generation chambers;

ink supply passages communicating the at least one ink reservoir with the pressure generation chambers; and pressure generation elements for causing the pressure generation chambers to generate pressure, wherein ink reservoir side opening parts of the ink supply passages in the proximity of an end part of the ink reservoir are arranged closely as compared with ink reservoir side opening parts of the ink supply passages in the proximity of a central part of the ink reservoir.

That is, in the ink jet record head of the invention, the ink reservoir side opening parts of the ink supply passages in the proximity of the end part of the ink reservoir are arranged closely as compared with the ink reservoir side opening parts of the ink supply passages in the proximity of the center part of the ink reservoir. Thus, if an air bubble enters the ink reservoir and remains in the proximity of the end part of the ink reservoir, the suction forces from the closely arranged ink supply passages are combined and the air bubble is strongly sucked, etc., during cleaning, etc., and is easily discharged from the ink reservoir. Although the suction force for each ink supply passage is weak, the combined suction force acting on the air bubble becomes strong and thus the air bubble can be discharged securely with a small suction force, etc. Thus, it is possible to reduce costs because of miniaturization of a suction pump, etc., increase the work speed because of shortening the suction time, and decrease the sucked ink amount, and occurrence of print failures in the presence of the air bubble remaining in the ink reservoir is also decreased.

In the ink jet record head of the invention, if the inertance acting on each pressure generation chamber in association with a flow passage from the opening part of the ink supply passage to the nozzle opening is set substantially equal, the inertance acting in each nozzle opening is equal and thus the ejection characteristics of the ink droplet speed, the ink droplet volume, etc., of each nozzle opening can be made substantially uniform and the print quality is stabilized.

The expression "substantially equal" means that the inertance is made uniform.

In the ink jet record head of the invention, if the inertance is made substantially equal by adjusting the cross-sectional areas of the ink supply passages, the inertance of one pressure chamber and that of another pressure chamber can be made uniform comparatively easily.

In the ink jet record head of the invention, if a narrow area having a cross-sectional area less than that of another portion (for example, the central part of the ink reservoir) is formed in the proximity of the end part of the ink reservoir, a plurality of ink supply passages positioned on the end part side of the ink reservoir from the proximity of the entrance of the narrow area effectively function to discharge an air bubble of such a size as to be caught in the entrance to the narrow area. Accordingly, an air bubble of the size comparatively hard to be discharged can be easily discharged. Alternatively, a large air bubble is caught in and stops at the entrance of the narrow area, only a small air bubble comparatively easily discharged enters the narrow area, and the large air bubble comparatively hard to be discharged does not enter the proximity of the end part of the ink reservoir. Thus, a print failure in the proximity of the end part can be prevented more effectively In the ink jet record head of the invention, if the ink flow passages are formed with island parts, it is possible to reduce print failures due to the presence of the air bubble remaining in the ink reservoir.

In the ink jet record head of the invention, if the inertance is made substantially equal by adjusting at least one of the width and length of the island parts, the inertance of one pressure chamber and that of another pressure chamber can be made uniform comparatively easily. In this case, either or both of the width and length of the shallow part may be adjusted.

If the ink jet record head of the invention comprises a nozzle plate formed with the nozzle openings, a flow passage formation plate formed with flow passages corresponding to the pressure generation chambers, the ink reservoirs, and the ink supply passages, and a seal plate for closing openings of the flow passages, it is possible to deduce print failures due to the presence of the air bubble remaining in the ink reservoir.

In the ink jet record head of the invention, if the flow passage formation plate is formed by a plurality of laminated metal plates formed with openings used as the flow passages, the flow passage formation plate in which the ink supply passages are bent, etc., in the proximity of the end part of the ink reservoir to closely arrange the opening parts of the ink supply passages can be manufactured easily. Also, the formation plate in which the widths of the ink supply passages are changed to make the inertance of each ink supply passage, etc., substantially equal can be manufactured easily.

In the ink jet record head of the invention, if the flow passage formation plate is formed by a plurality of laminated photosensitive resin sheets formed with openings used as the flow passages by light exposure, the plate in which the ink supply passages are bent, etc., in the proximity of the end parts of the ink reservoirs to closely arrange the opening parts of the ink supply passages can be manufactured easily. Also, the plate in which the widths of the ink supply passages are changed to make the inertance of each ink supply passage, etc., substantially equal can be manufactured easily.

In the ink jet record head of the invention, if the flow passage formation plate is made of monocrystalline silicon formed with the flow passages by etching, the plate formed with the ink supply passages having the island parts can be manufactured comparatively easily. Further, in the case of the ink supply passages having the island parts, the inertance of one pressure chamber and that of another pressure chamber can be made substantially equal by simply adjusting the width and/or length of the island part.

In the ink jet record head of the invention, if the pressure generation chambers communicating with one of an opposed pair of ink reservoirs and the pressure generation chambers communicating with the other thereof are arranged alternately, if the nozzle openings are disposed like a staggered arrangement to communicate with a respective one of the pair of ink reservoirs facing each other, or if each of the nozzle openings is disposed on the side of the associated pressure generation chamber away from the associated ink reservoir, the spacing between the adjacent opening parts of the ink supply passages is likely to be wide and an air bubble becomes hard to be discharged accordingly and in addition, the ink flow velocity in the proximity of the end part of the ink reservoir during the suction is like to be lowered. Therefore, the invention is effectively applied to these arrangement to provided the remarkable effect of positively discharging an air bubble in the proximity of the end part.

The present disclosure relates to the subject matter contained in Japanese patent application No.2000-010655 (filed on Jan. 19, 2000) and Japanese patent application No.2000-395378 (filed on Dec. 26, 2000), which are expressly incorporated herein by reference in their entireties.

DESCRIPTION OF THE PREFERRED EMBODIMENT

Referring now to the accompanying drawings, there are shown preferred embodiments of the invention.

Figure 1:
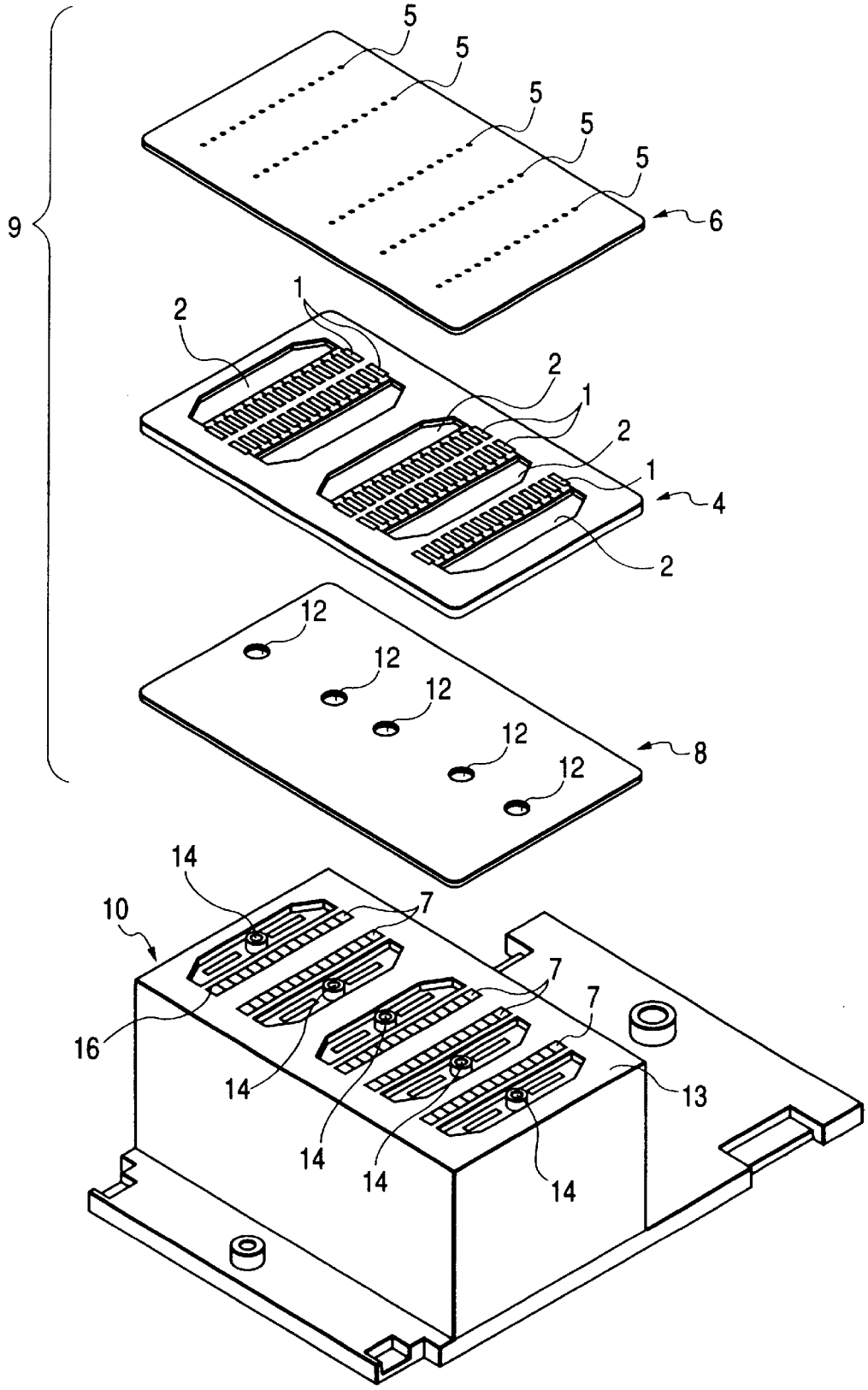
FIG. 1 is an exploded perspective view to show an ink jet record head of one embodiment of the invention.
Figure 2:
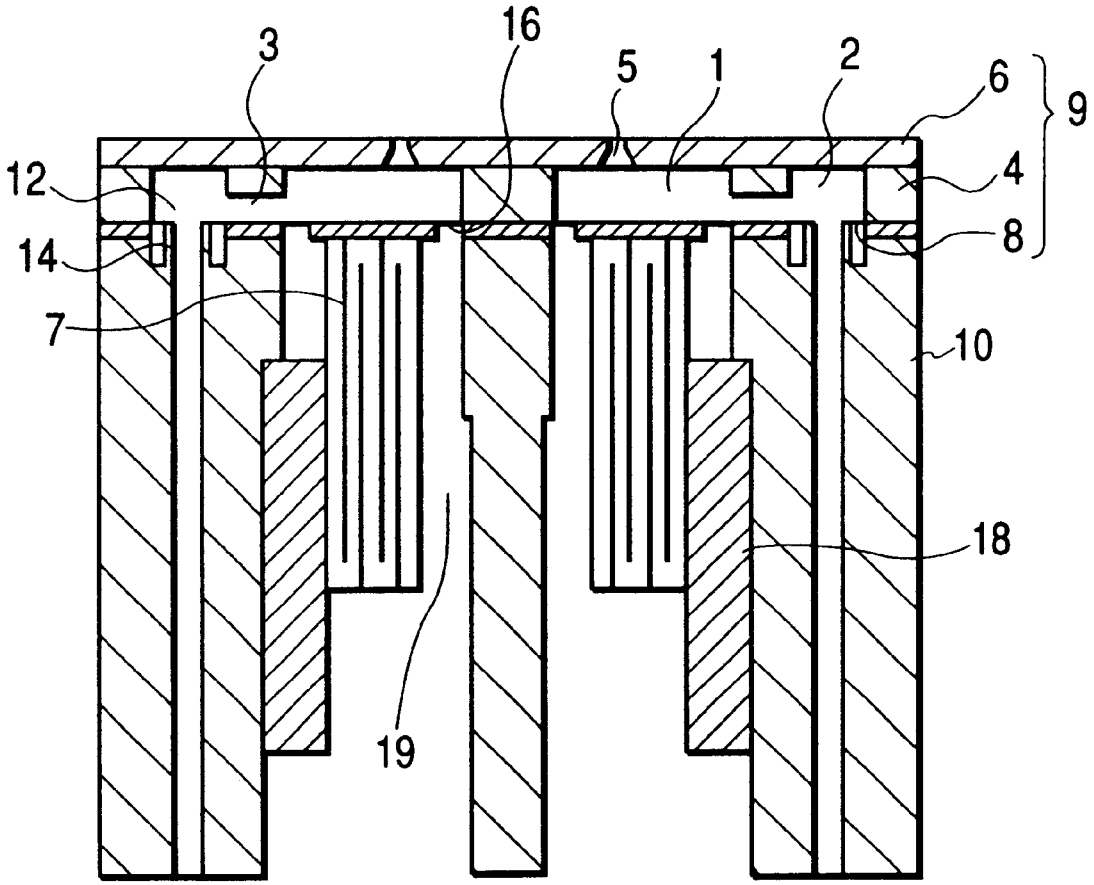
FIG. 2 is a sectional view to show the ink jet record head of the embodiment of the invention.
Figure 9:
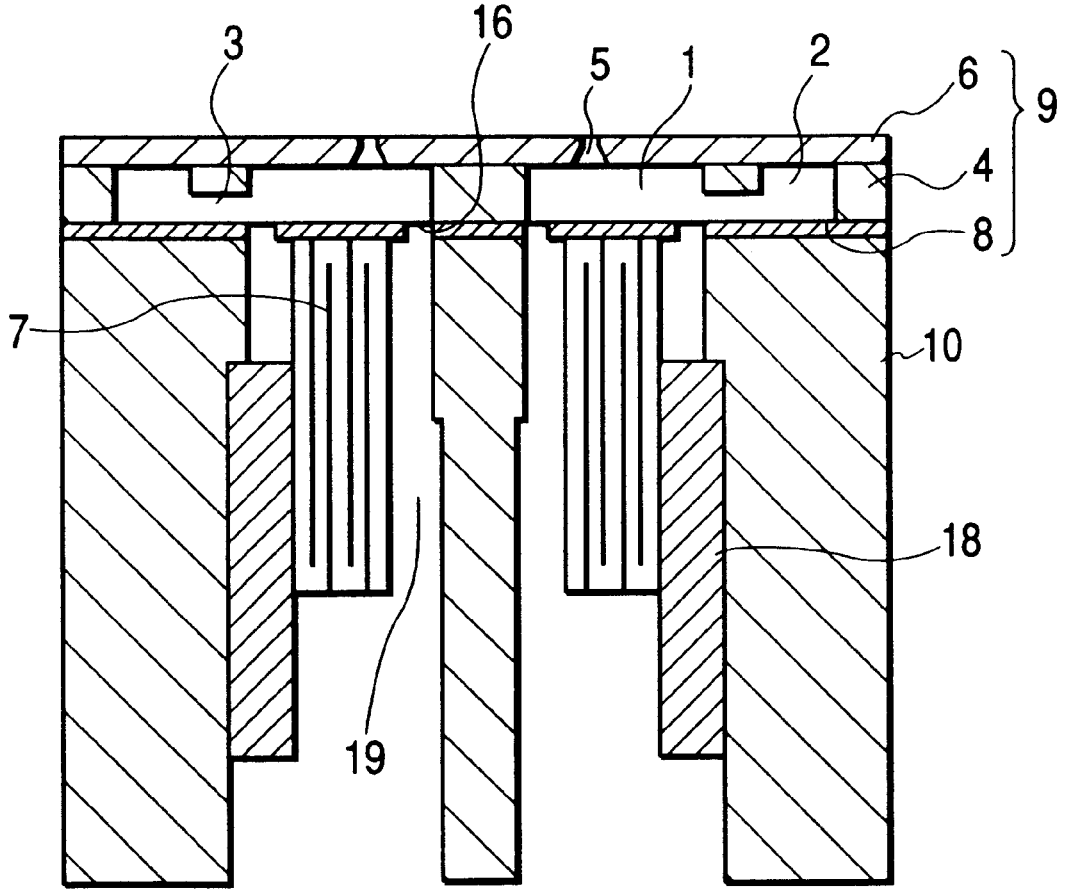
FIG. 9 is a sectional view to show an ink jet record head in a related art.
Figure 10:
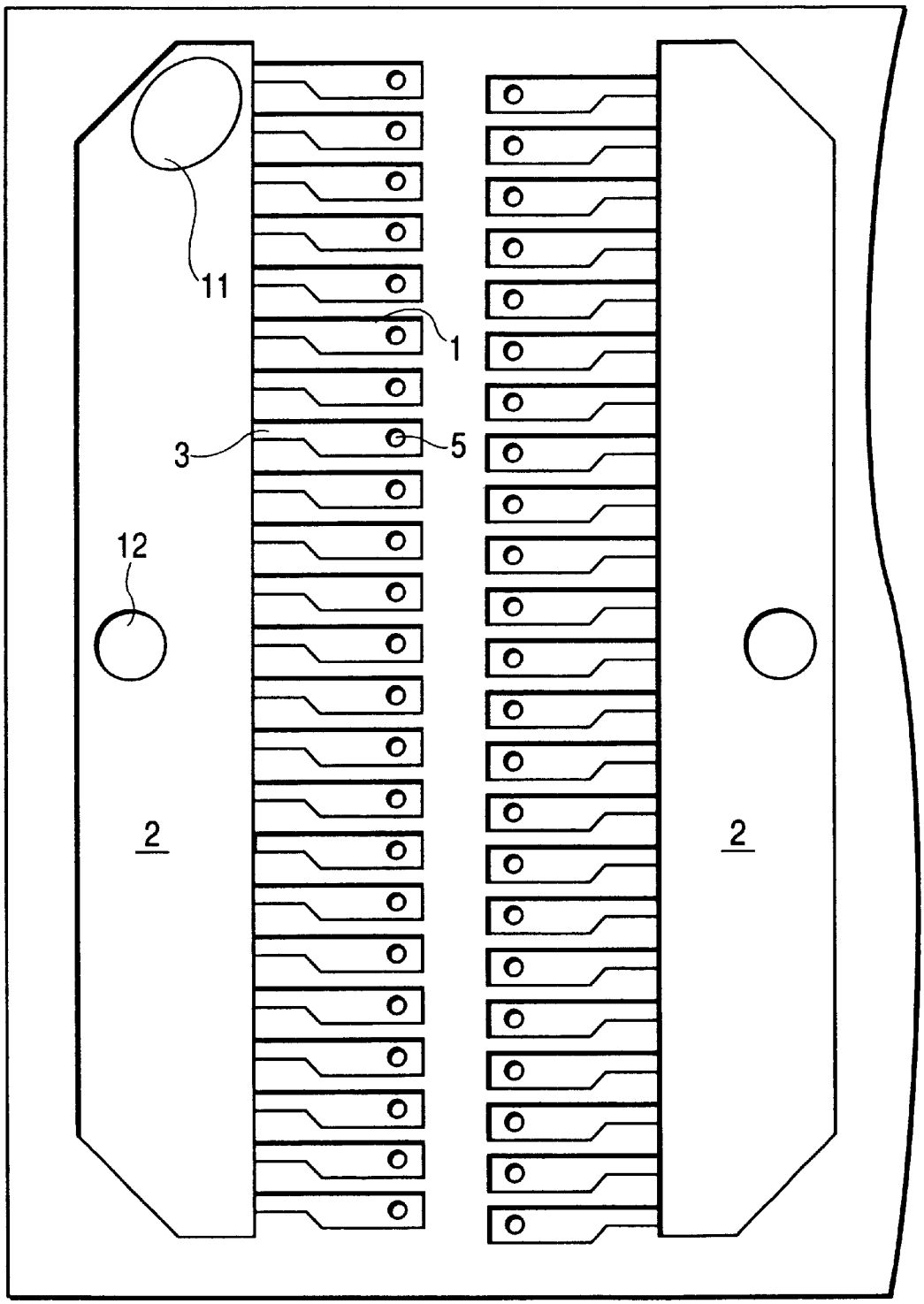
FIG. 10 is a schematic representation to show flow passages of the ink jet record head in the related art.
Figure 11:
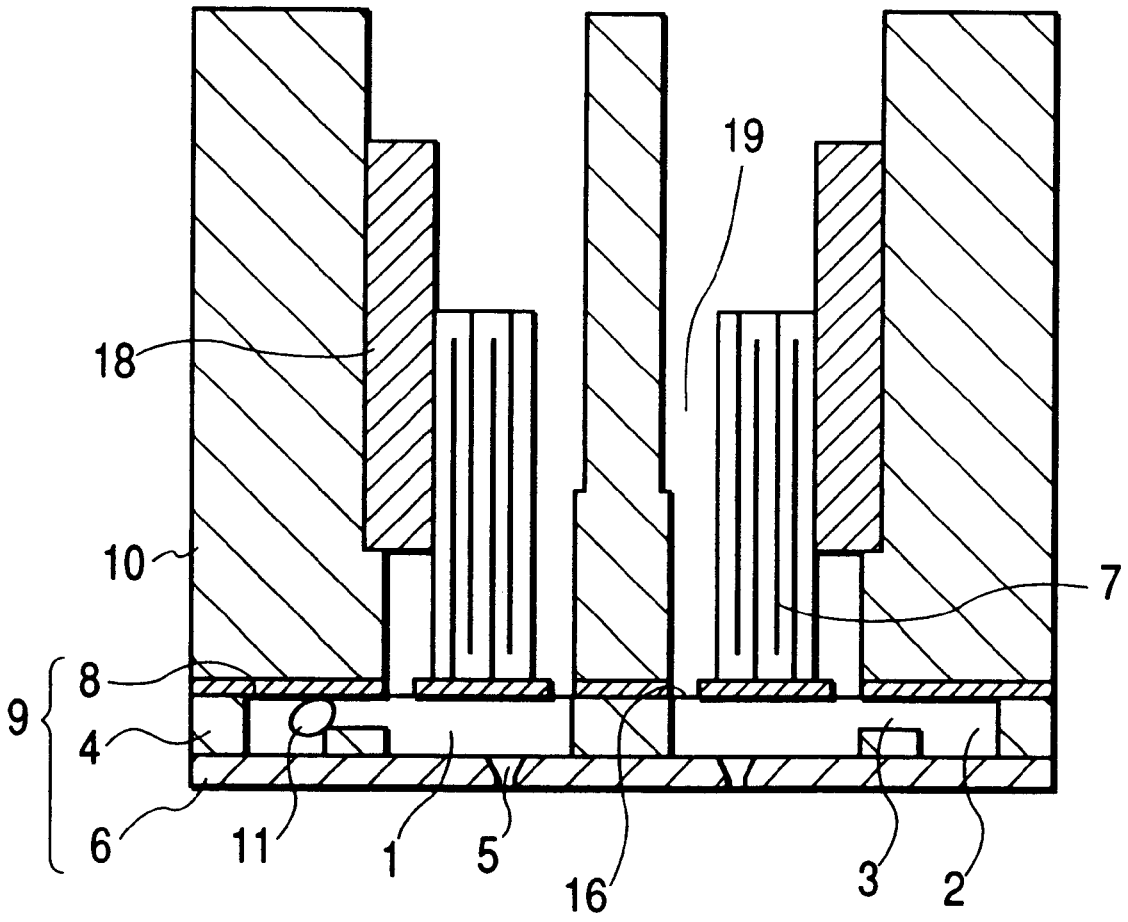
FIG. 11 is a sectional view to show the use state of the ink jet record head in the related art.

FIGS. 1 and 2 are drawings to show one embodiment of an ink jet record head of the invention. This record head basically is similar to that shown in FIGS. 9 and 10, and parts similar to those previously described with reference to FIGS. 9 and 10 are denoted by the same reference numerals in the description that follows.

The record head comprises a head case 10 and a flow passage unit 9 fixedly secured to a unit fixation face 13 of the head case 10 with an adhesive, etc. The flow passage unit 9 is made up of a nozzle plate 6, a flow passage board 4, and a vibration plate 8 stacked and bonded one on an another.

The nozzle plate 6, which is a stainless plate, is formed with a large number of nozzle openings 5 arrayed in a plurality of rows (in this embodiment, five rows are provided, but the invention is applicable to the nozzle opening array of a single row or any desired number of rows). The flow passage board 4 is formed with flow passages, which include pressure generation chambers 1 communicating with the respective nozzle openings 5, common ink reservoirs 2 for temporarily storing ink to be ejected through the nozzle openings 5, and ink supply passages 3, each for supplying ink from the associated ink reservoir 2 to the respective pressure generation chamber 1. The pressure generation chambers 1 are arrayed at predetermined intervals to correspond in location to the respective nozzle openings 5, and each ink reservoir 2 is elongated along the row of the associated pressure generation chambers 1.

The vibration plate 8 is a composite plate of a resin sheet and a stainless sheet, and is formed with ink supply ports 12 for introducing ink into the respective ink reservoirs 2.

The head case 10 is formed by injection molding of a thermosetting resin or a thermoplastic resin, and is provided with ink supply tubes 14 in the portions of the unit fixation face 13 corresponding to the ink supply ports 12 for introducing ink into the ink reservoirs 2. The head case 10 is also formed with windows 16 in the portions corresponding to the rows of the pressure generation chambers 1 for exposing piezoelectric vibrators 7, a kind of pressure generation element. In FIG. 2, numeral 18 denotes a fix board for fixing the piezoelectric vibrators 7 thereon to form a piezoelectric vibrator unit, and numeral 19 denotes a housing chamber for housing the piezoelectric vibrator unit comprising the piezoelectric vibrators 7 and the fix board 18.

In the record head, a drive signal is input to the piezoelectric vibrator 7, thereby expanding and contracting the piezoelectric vibrator 7 for vibrating the vibration plate 8. This causes pressure fluctuation in the associated pressure generation chamber 1 to eject an ink droplet from the associated nozzle opening 5.

Figure 3:
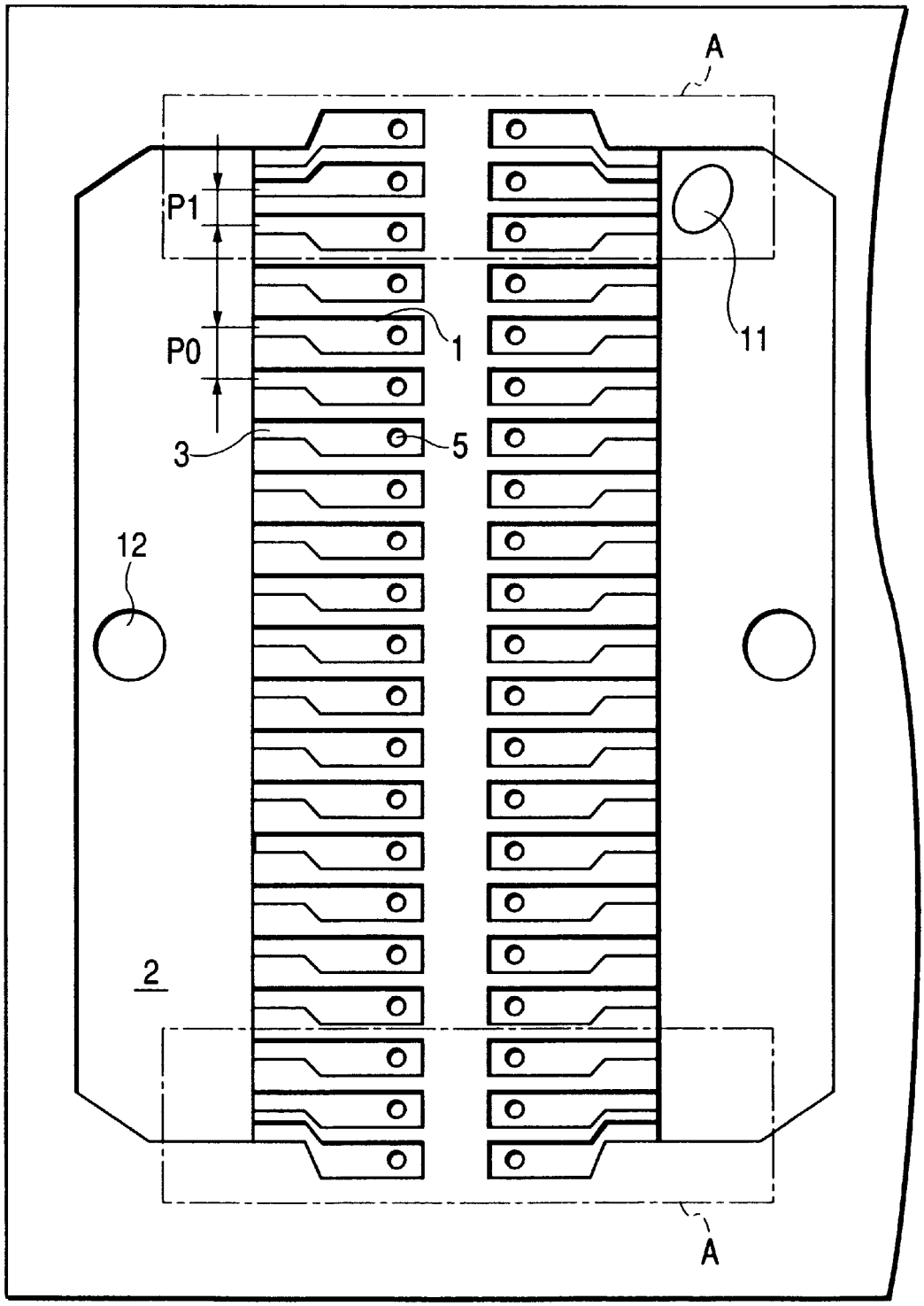
FIG. 3 is a schematic representation to show flow passages of the ink jet record head of the embodiment of the invention.

As shown in FIG. 3, in the record head, the three ink supply passages 3 in the proximity of each end part of the ink reservoir 2 (i.e. in the area A surrounded by the dash line in FIG. 3) are designed such that opening parts thereof to the ink reservoir 2 are located close to one another. That is, the pitch of the opening parts of the ink supply passages 3 in any other portion than the area A is P0, which is the same as the pitch of the nozzle openings 5 and that of the pressure generation chambers 1, whereas the pitch of the opening parts of the ink supply passages 3 in the area A is P1 smaller than P0. In addition, the pitch of the ink supply passage opening parts my vary in another stepwise manner or gradually so that the pitch of the adjacent opening parts close to the elongating end of the ink reservoir 2 is smaller than the pitch of the adjacent opening parts far from the elongating end.

In the record head, the ink supply passages 3 positioned at each end part of the ink reservoir 2 are bent so that the opening parts of the three ink supply passages 3 in the proximity of the end part are located closely. Consequently, the ink supply passages 3 at the end parts are longer in length than other ink supply passages 3, so that the inertance (i.e. the flow resistance) acting on the pressure generation chambers 1 at the end parts will be increased. For this reason, the record head of the embodiment is designed so that each of the ink supply passages 3 at the end parts is made wider in width than any other ink supply passage 3 to have a longer cross-sectional area. Accordingly, the inertance acting on each pressure generation chamber 1 in association with the flow passage from the ink reservoir side opening part of the ink supply passage 3 to the nozzle opening 5 is made substantially equal. The inertance of one pressure chamber and that of another pressure chamber are thus made uniform, whereby the ejection characteristics, such as the ink droplet speed, the ink droplet volume, etc., of each nozzle opening 5 can be made substantially uniform and the print quality can be stabilized.

In this embodiment, the flow passage board 4 is formed by stacking and laminating stainless plates formed with the opening parts corresponding to the pressure generation chambers 1, the ink supply passages 3, and the ink reservoirs 2 by a press, etc. This make is possible to readily manufacture the flow passage board 4, in which the ink supply passages 3 are bent at the end parts of the ink reservoirs 2 to locate the opening parts thereof closely. This also makes it possible to readily manufacture the flow passage board, in which the widths of the ink supply passages 3 are changed for making the inertance of each ink supply passage 3, etc., substantially equal.

In the record head, if an air bubble 11 enters the ink reservoir 2 and remains in the proximity of the end part of the ink reservoir 2, the combined suction force from the closely arranged ink supply passages 3 acts on the air bubble 11 during cleaning, etc., so that the air bubble 11 is strongly sucked, etc., and is easily discharged from the ink reservoir 2. Since the air bubble 11 can be discharged securely with a small suction force, etc., it is possible to reduce costs because of miniaturization of a suction pump, etc., increase the work speed because of shortening the suction time, and decrease the sucked ink amount, and occurrence of print failures in the presence of the air bubble 11 remaining in the ink reservoir 2 is also decreased.

Figure 4:
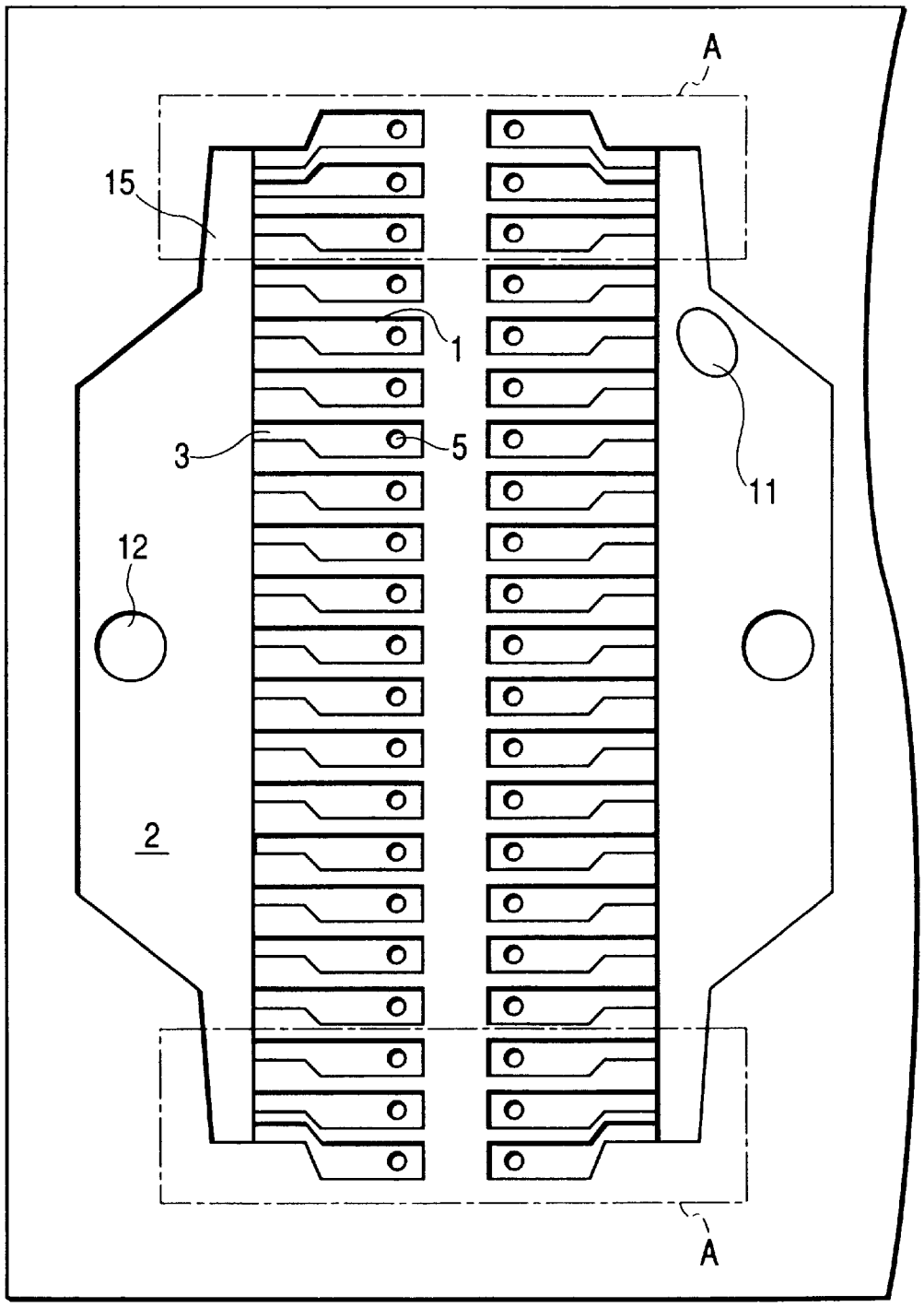
FIG. 4 is a schematic representation to show flow passages of an ink jet record head of a second embodiment of the invention.

FIG. 4 shows flow passages of an ink jet record head of a second embodiment of the invention. The record head differs from that previously described with reference to FIGS. 1 to 3 only in that the proximity of each end part of each ink reservoir 2 (area A surrounded by the dash line in FIG. 4) is made narrow, and each narrow area 15 having a cross-sectional area less than that of any other portion is formed. Parts similar to those previously described with reference to FIGS. 1 to 3 are denoted by the same reference numerals in FIG. 4.

In the record head to discharge an air bubble of such a size as to be caught in the entrance to the narrow area, the narrow area 15 serves to effectively apply the combined suction force to the air bubble from a plurality of ink supply passages positioned on the end part side of the ink reservoir from the proximity of the entrance of the narrow area (i.e. positioned facing the narrow area 15), therefore, even an air bubble of the size comparatively hard to be discharged can be easily discharged, and a print failure in the proximity of the end part can be prevented more effectively. In addition, this embodiment also provides similar advantages to those of the record head previously described with reference to FIGS. 1 to 3.

Figure 5:
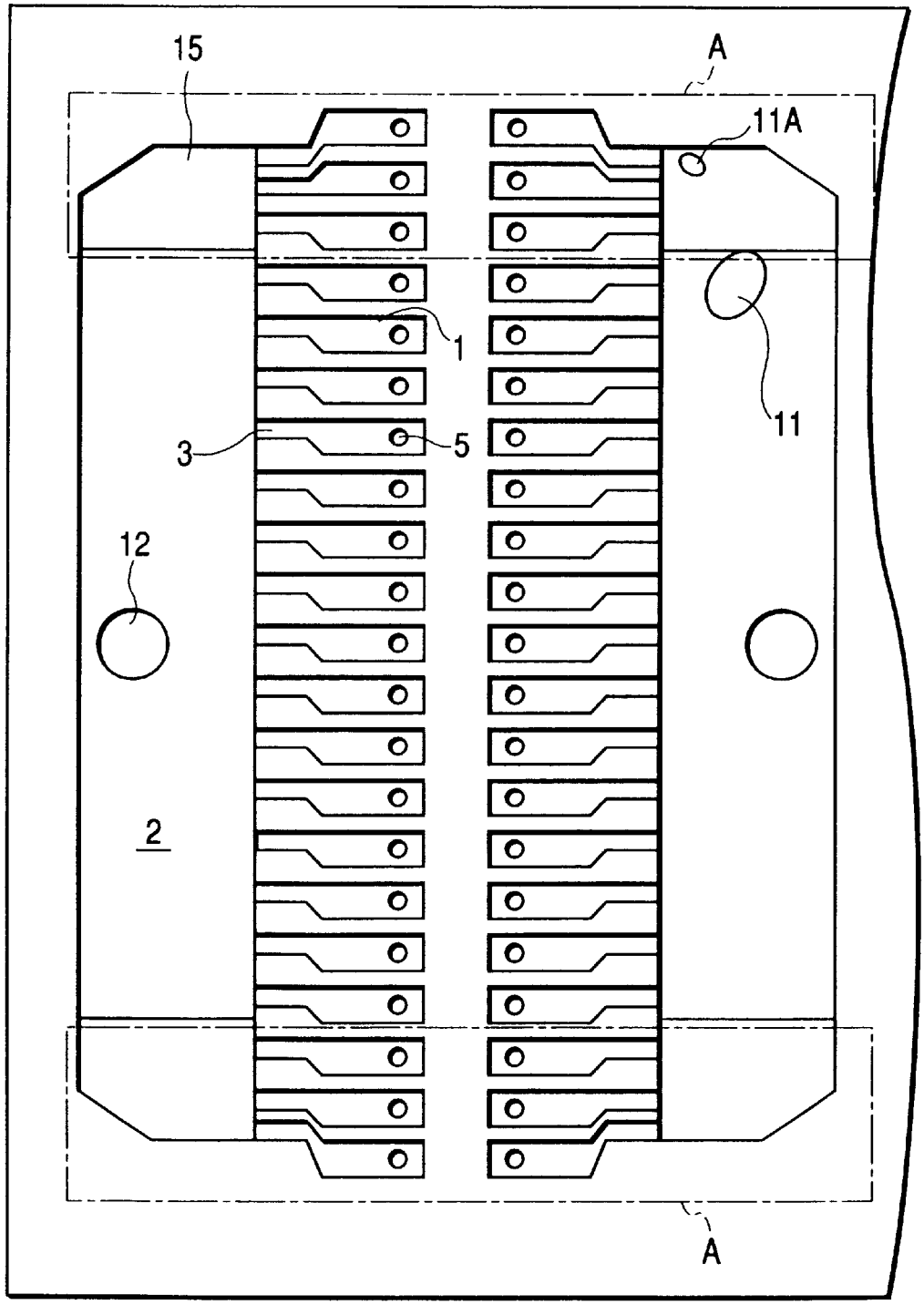
FIG. 5 is a schematic representation to show flow passages of an ink jet record head of a third embodiment of the invention.
Figure 6:
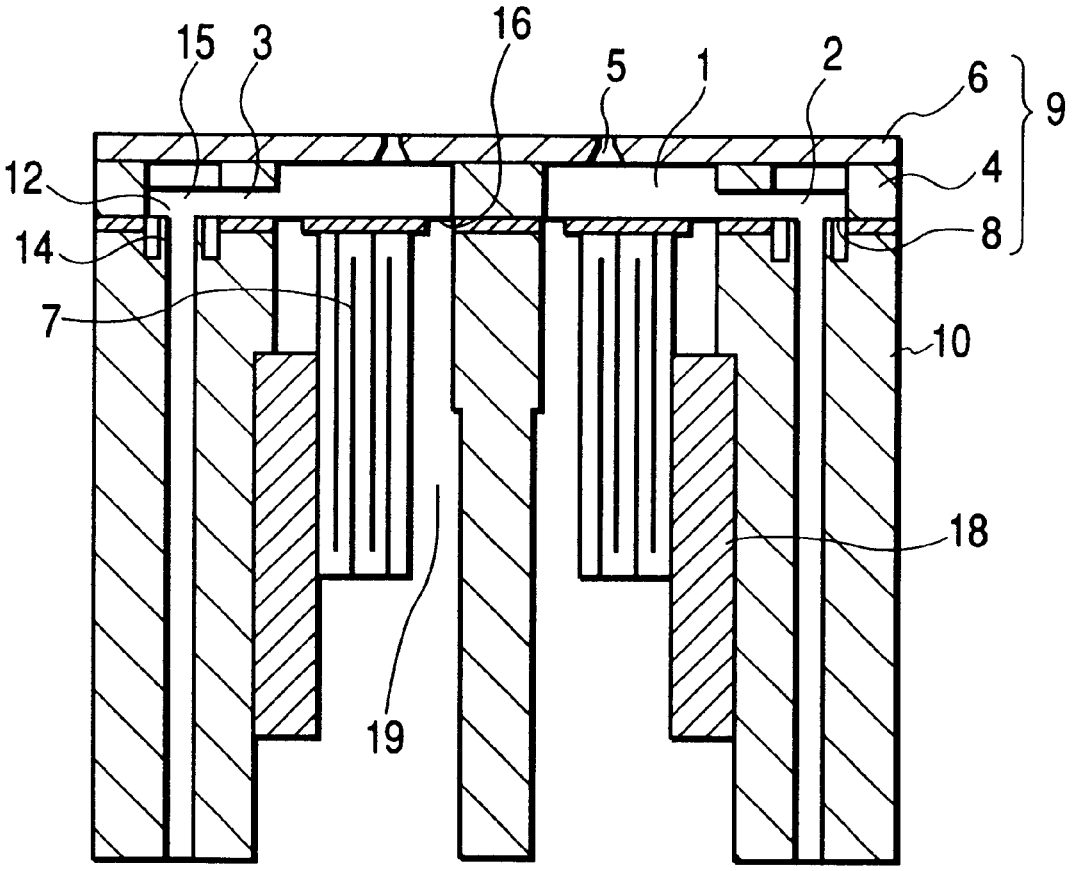
FIG. 6 is a sectional view to show the ink jet record head of the third embodiment of the invention.

FIGS. 5 and 6 show flow passages of an ink jet record head of a third embodiment of the invention. The record head differs from that previously described with reference to FIGS. 1 to 3 only in that a step part for making the depth dimension of the ink reservoir 2 smaller is provided in the proximity of each end part of each ink reservoir 2 (area A surrounded by the dash line in FIG. 5). That is, the step part defines the narrow area 15 having a cross-sectional area less than that of any other portion. Parts similar to those previously described with reference to FIGS. 1 to 3 are denoted by the same reference numerals in FIGS. 5 and 6.

In the record head, a large air bubble 11 is caught in and stops at the entrance of the narrow area 15, and only a small air bubble 11A comparatively easily discharged enters the narrow area 15. Since the large air bubble 11 comparatively hard to be discharged does not enter the proximity of the end part of the ink reservoir 2, a print failure in the proximity of the end part can be prevented more effectively. In addition, this embodiment also provides similar advantages to those of the record head previously described with reference to FIGS. 1 to 3.

In the above-described embodiments, the flow passage board 4 is formed by stacking and laminating stainless steel plates formed with the openings corresponding to the pressure generation chambers 1, the ink supply passages 3, and the ink reservoirs 2 by a press, etc. The flow passage board 4 may be formed by laminated photosensitive resin sheets, in which openings corresponding to the flow passages of the pressure generation chambers 1, the ink supply passages 3, the ink reservoirs 2, etc., are formed by light exposure and developing.

Figure 7:
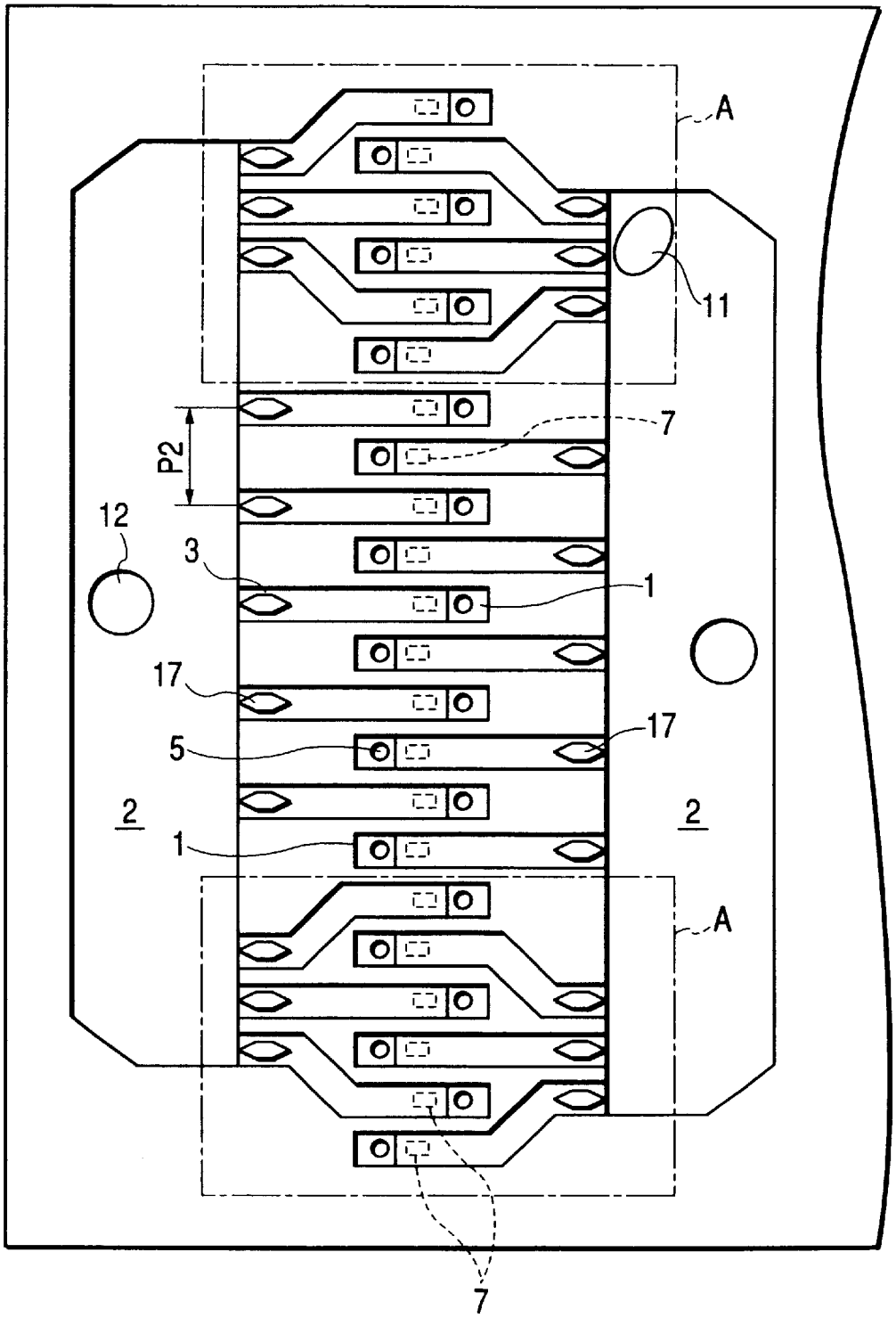
FIG. 7 is a schematic representation to show flow passages of an ink jet record head of a fourth embodiment of the invention.
Figure 8:
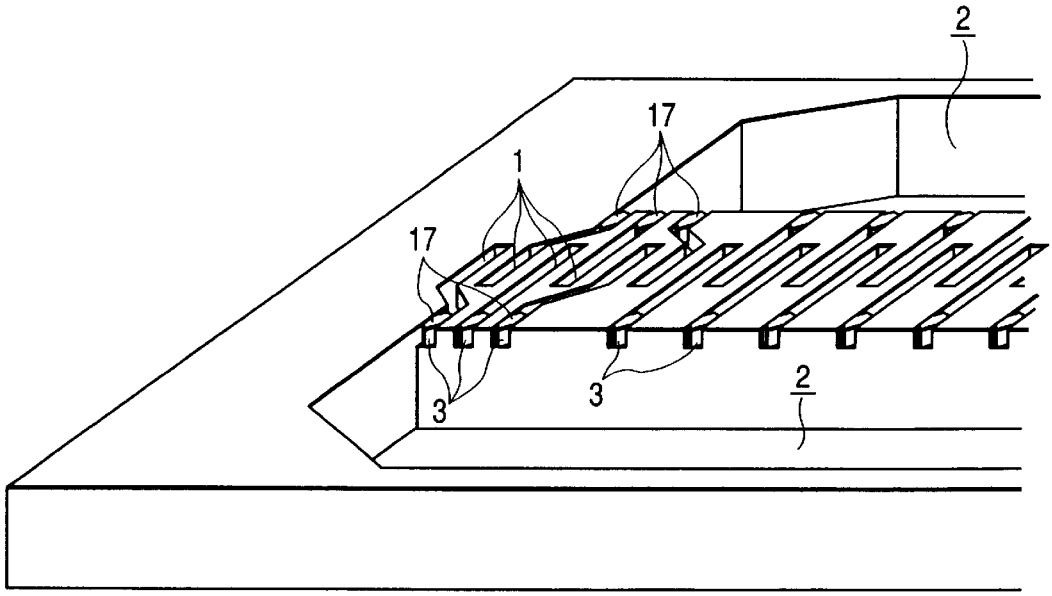
FIG. 8 is a perspective view to show the proximity of end parts of ink reservoirs in the ink jet record head shown in FIG. 7.

FIG. 7 shows flow passages of an ink jet record head of a fourth embodiment of the invention. FIG. 8 is a perspective view to show the proximity of end parts of ink reservoirs 2 of the ink jet record head shown in FIG. 7.

In the record head, ink supply passages 3 for communication between the pressure generation chambers 1 and the associated ink reservoir 2 have substantially equal widths, and an island part 17 is formed in each of the ink supply passages 3.

The pressure generation chambers 1 are arrayed so that the pressure generation chambers 1 communicating with one of the two opposed ink reservoirs 2 and the pressure generation chambers 1 communicating with the other ink reservoir 2 are alternately arranged as a staggered or zig-zag arrangement. Namely, one group of the pressure generation chambers 1 arranged like comb teeth and the other group arranged like comb teeth are disposed so as to mesh with each other. Each of the nozzle openings 5 is arranged on the side of the respective elongated pressure generation chamber 1 away from the associated ink reservoir 2, so that the nozzle openings 5 are disposed like a staggered arrangement. Piezoelectric vibrators 7 are disposed between one row of the nozzle openings 5 and the other row. Different color inks are supplied and ejected from the opposed ink reservoirs 2, respectively.

Thus, if the pressure generation chambers 1 communicating with one ink reservoir 2 and the pressure generation chambers 1 communicating with the other ink reservoir 2 are arranged in the state in which they are meshed with each other from both sides so as to dispose the nozzle openings 5 like a staggered arrangement and the piezoelectric vibrators 7 are aligned on a phantom line between one row of the nozzle openings 5 and the other row, the piezoelectric vibrators 7 (a piezoelectric vibrator group) obtained by separating one bulk into a comb teeth shape can be efficiently used, for example, such that the odd'th-numbered piezoelectric vibrators 7 counted from the end of the piezoelectric vibrator group are joined to vibration plate 8 to correspond to the pressure generation chambers 1 communicating with one ink reservoir 2 and the even'th-numbered piezoelectric vibrators 7 are joined to the vibration plate 8 to correspond to the pressure generation chambers 1 communicating with the other ink reservoir 2. Therefore, even if two rows of the nozzle openings 5 are provided to eject two types of ink, the single piezoelectric vibrator group obtained from one bulk is only needed. Thus, the number of the piezoelectric vibrator groups used with the ink jet record head can be halved, the number of parts can be reduced, and the steps of attaching the piezoelectric vibrators 7 can be decreased, so that manufacturing the record head is facilitated and the manufacturing costs can be reduced.

If the pressure generation chambers 1 communicating with one ink reservoir 2 and the pressure generation chambers 1 communicating with the other ink reservoir 2 are arranged in the state in which they are meshed with each other from both sides, the spacing between one row of the nozzle openings 5 and the other row can be set smaller than that in the related art. The reduction of the spacing between one row of the nozzle openings 5 and the other row results in the reduction of a positional offset on a record medium between ink droplets ejected from the nozzle opening 5 of one row and that of the other row. This makes it possible to precisely locate dots on the medium, and contributes to sharpening an image. Particularly, an image can be remarkably sharpened in a case where the nozzle openings 5 of these rows eject two color inks which will conspicuous if the dot positions are offset.

Preferably, the described record head uses a flow passage board made of monocrystalline silicon formed with the flow passages including the pressure generation chambers 1, the ink supply passages 3, and the ink reservoirs 2 by etching as the flow passage board 4. This makes it easy to form the ink supply passages 3 with the shallow parts 17. This also makes it easy to manufacture the flow passage board 4, in which the widths and lengths of the island parts 17 are changed for making the inertance of each ink supply passage 3, etc., substantially equal. If the inertance is thus made uniform, the ejection characteristics of the ink droplet speed, the ink droplet volume, etc., of each nozzle opening 5 can be made substantially uniform, and therefore the print quality can be stabilized.

Other points are similar to those previously described with reference to FIGS. 1 to 3 and parts similar to those in FIGS. 1 to 3 are denoted by the same reference numerals in FIGS. 7 and 8.

In the record head, pitch P2 of the opening parts of the ink supply passages 3 in other portions than areas A becomes large, and the air bubble 11 becomes hard to be discharged accordingly, and particularly the flow velocity in the proximity of the end part at the suction time is likely to be lowered. For this reason, by closely arranging the opening parts in the proximity of the end part, the effect of positively discharging the air bubble 11 is remarkable. The above-described narrow areas 15 may be provided, but, in this case, the narrow areas 15 will be fairly large, and it is feared that pressure fluctuation in the ink reservoir during ink ejection may not completely be absorbed by the narrow area.

Therefore, the spacing between the ink supply passages 3 in the proximity of the end part of the ink reservoir 2 narrower than any other portion is remarkable and effective to positively discharge the air bubble 11. In addition, this embodiment also provides similar advantages to those of the record head previously described with reference to FIGS. 1 to 3.

In the above-described embodiments, the opening parts of the three ink supply passages 3 in the proximity of each end part of the ink reservoir 2 are arranged closely, but the invention is not limited to the manner, and two ink supply passages may be arranged closely or four or more ink supply passages can also be arranged closely. In the above-described embodiments, the invention is applied to the record heads using the piezoelectric vibrators 7 in vertical vibration mode, but is not limited thereto and can also be applied to record heads using piezoelectric vibrators in deflection vibration mode. The invention can also be applied to record heads of so-called bubble jet type using heating elements as pressure generation elements to boil ink in the pressure generation chambers for ejecting ink droplets. Magnetostriction elements may be used as the pressure generation chambers.

As described above, according to the ink jet record head of the invention, if an air bubble enters the ink reservoir and remains in the proximity of the end part of the ink reservoir, it is sucked, etc., strongly from the closely arranged ink supply passages during cleaning, etc., and is easily discharged from the ink reservoir. Since the air bubble can be discharged securely with a small suction force, etc., it is possible to reduce costs because of miniaturization of a suction pump, etc., increase the work speed because of shortening the suction time, and decrease the sucked ink amount, and occurrence of print failures in the presence of the air bubble remaining in the ink reservoir is also decreased.

What is claimed is:

1. An ink jet record head comprising:

pressure generation chambers arrayed in at least one row and associated with at least one nozzle openings;

at least one common ink reservoir elongated along a row direction of the pressure generation chambers;

ink supply passages communicating the at least one ink reservoir with the pressure generation chambers; and pressure generation elements for causing the pressure generation chambers to generate pressure, wherein ink reservoir side opening parts of the ink supply passages in the proximity of an end part of the ink reservoir are arranged closely as compared with ink reservoir side opening parts of the ink supply passages in the proximity of a central part of the ink reservoir.

2. The ink jet record head as claimed in claim 1, wherein inertance acting on each pressure generation chamber in association with a flow passage from the ink reservoir side opening part of the ink supply passage to the nozzle opening is set substantially equal.

3. The ink jet record head as claimed in claim 2, wherein cross-sectional areas of the ink supply passages are adjusted to make the inertance substantially equal.

4. The ink jet record head as claimed in claim 1, wherein a narrow area having a cross-sectional area less than a cross-sectional area of another portion is formed in the proximity of the end part of the ink reservoir.

5. The ink jet record head as claimed in claim 1, wherein the ink flow passages are formed with island parts.

6. The ink jet record head as claimed in claim 5, wherein the inertance is made substantially equal by adjusting at least one of the width and length of the island parts.

7. The ink jet record head as claimed in claim 1, comprising a nozzle plate formed with the nozzle openings, a flow passage formation plate formed with flow passages corresponding to the pressure generation chambers, the ink reservoir, and the ink supply passages, and a seal plate for closing openings of the flow passages.

8. The ink jet record head as claimed in claim 7, wherein the flow passage formation plate includes a plurality of laminated metal plates formed with openings used as the flow passages.

9. The ink jet record head as claimed in claim 7, wherein the flow passage formation plate includes a plurality of laminated photosensitive resin sheets formed with openings used as the flow passages by light exposure.

10. The ink jet record head as claimed in claim 7, wherein the flow passage formation plate includes a monocrystalline silicon plate formed with the flow passages by etching.

11. The ink jet record head as claimed in claims 1, wherein the at least one ink reservoir includes a pair of the ink reservoirs arranged opposite to each other, and the pressure generation chambers communicating with one of the ink reservoirs and the pressure generation chambers communicating with the other thereof are arranged alternately.

12. The ink jet record head as claimed in claim 11, wherein the nozzle openings communicating with the one ink reservoir and the nozzle openings communicating with the other ink reservoir are arranged alternately and in a zig-zag manner.

13. The ink jet record head as claimed in claim 12, wherein each of the nozzle openings is disposed on a side of the associated pressure generation chamber away from the associated ink reservoir.

14. The ink jet record head as claimed in claim 13, wherein the pressure generation elements are aligned on a phantom line between one row of the nozzle openings and the other row.

15. A flow passage formation plate adapted to an ink jet head, the plate comprising:

pressure generating chambers arrayed in at least one row and associated with nozzle openings;

at least one common ink reservoir elongated in a row direction of the pressure chambers;

ink supply passages arrayed in at least one row and associated with the pressure generating chambers, the ink supply passages having opening parts through which the ink supply passages are communicated with the at least one ink reservoir, wherein:

a first adjacent pair of the opening parts has a first pitch;

a second adjacent pair of the opening parts has a second pitch; and the first pitch is smaller than the second pitch.

16. A flow passage formation plate adapted to an ink jet head, the plate comprising:

pressure generating chambers arrayed in at least one row and associated with nozzle openings;

at least one common ink reservoir elongated in a row direction of the pressure chambers;

ink supply passages arrayed in at least one row and associated with the pressure generating chambers and the at least one ink reservoir, wherein:

a first one of the ink supply passages has a first cross-sectional area;

a second one of the ink supply passages has a second cross-sectional area; and the first cross-sectional area is smaller than the second cross-sectional area.

* * * * *